US007472843B2

(12) United States Patent
Pearson et al.

(10) Patent No.: US 7,472,843 B2
(45) Date of Patent: Jan. 6, 2009

(54) AIR INDUCTION LIQUID SPRAY NOZZLE ASSEMBLY

(75) Inventors: Steve Pearson, Wheaton, IL (US); Marc Arenson, Carol Stream, IL (US); Eric Greenawalt, Ruffsdale, PA (US)

(73) Assignee: Spraying Systems Co., Wheaton, IL (US)

( * ) Notice: Subject to any disclaimer, the term of this patent is extended or adjusted under 35 U.S.C. 154(b) by 0 days.

(21) Appl. No.: 11/630,733

(22) PCT Filed: Jun. 23, 2005

(86) PCT No.: PCT/US2005/022217

§ 371 (c)(1),
(2), (4) Date: Feb. 5, 2007

(87) PCT Pub. No.: WO2006/002300

PCT Pub. Date: Jan. 5, 2006

(65) Prior Publication Data

US 2008/0087745 A1 Apr. 17, 2008

Related U.S. Application Data

(60) Provisional application No. 60/582,339, filed on Jun. 23, 2004.

(51) Int. Cl.
*E03C 1/08* (2006.01)

(52) U.S. Cl. ..... 239/428.5; 239/419.5; 239/432; 239/500; 239/600

(58) Field of Classification Search ..... 239/419.5, 239/424, 424.5, 425.5, 428.5, 432, 550, 500, 239/600

See application file for complete search history.

(56) References Cited

U.S. PATENT DOCUMENTS 4,330,086 A * 5/1982 Nysted ..... 239/432
4,477,026 A * 10/1984 Lockwood ..... 239/428.5
5,615,836 A * 4/1997 Graef ..... 239/428.5
6,712,293 B2 * 3/2004 Swan ..... 239/419.5

* cited by examiner

*Primary Examiner*—Steven J Ganey
(74) *Attorney, Agent, or Firm*—Leydig, Voit & Mayer, Ltd.

(57) ABSTRACT

A spray nozzle assembly comprising a nozzle body and a separate nozzle body insert adapted for removable snap action engagement with the body. The nozzle body insert defines a liquid flow passage that includes an inlet section for communicating with a liquid inlet, a metering orifice for accelerating the liquid flow stream, and a downstream expansion section. The body insert further includes a venturi passage communicating with the expansion section for drawing ambient air into the liquid flow stream for stabilizing the liquid prior to discharge from the nozzle. In the illustrated embodiment, the expansion chamber communicates with a transverse passage of the nozzle body, which in turn communicates with a laterally oriented discharge orifice.

21 Claims, 2 Drawing Sheets

AIR INDUCTION LIQUID SPRAY NOZZLE ASSEMBLY

FIELD OF THE INVENTION

The present invention relates generally to spray nozzle assemblies, and more particularly, to spray nozzle assemblies adopted for spraying agricultural chemicals.

BACKGROUND OF THE INVENTION

Agricultural sprayers typically have a spray boom with a plurality of spray nozzles which are adapted for directing various agricultural chemicals, such as herbicides, pesticides and the like. While it is desirous to efficiently break the liquid down into particles for optimum crop application, generation of relatively fine particles, such as particles having a diameter of less than 150 microns, can be detrimental. These fine particles are subject to drift which can cause pollution to surrounding areas, damage to vegetation not intended to be sprayed, and waste of chemicals. Efforts to design spray nozzles that effect efficient liquid particle breakdown without generation of fine particles having diameters less than 150 microns have presented difficulties. Some attempts to develop such spray nozzles have resulted in spray assemblies that are relatively complex and expensive. Moreover, such prior spray nozzles often do not lend themselves to easy cleaning, which can be necessary due to buildup of contaminants and solid materials in the liquid flow passageways and orifices and during usage.

OBJECTS AND SUMMARY OF THE INVENTION

It is an object of the present invention to provide a spray nozzle assembly which is adapted for generating and discharging liquid sprays for more efficient application on agricultural foliage without undesirable drift.

Another object is to provide a spray nozzle assembly as characterized above which is effective for generating liquid sprays discharges in which a substantial proportion of the liquid particles are relatively large in diameter, such as about 500 microns in diameter, with substantially no particles having diameters less than 150 microns in diameter.

Another object is to provide a spray nozzle assembly of the above kind which is adapted for easy assembly and disassembly for periodic cleaning.

A further object is to provide a spray nozzle assembly of the foregoing type that is adapted for relatively economical manufacture.

Other objects and advantages of the invention will become apparent upon reading the following detailed description and upon reference to the drawings, in which:

Figure 1:
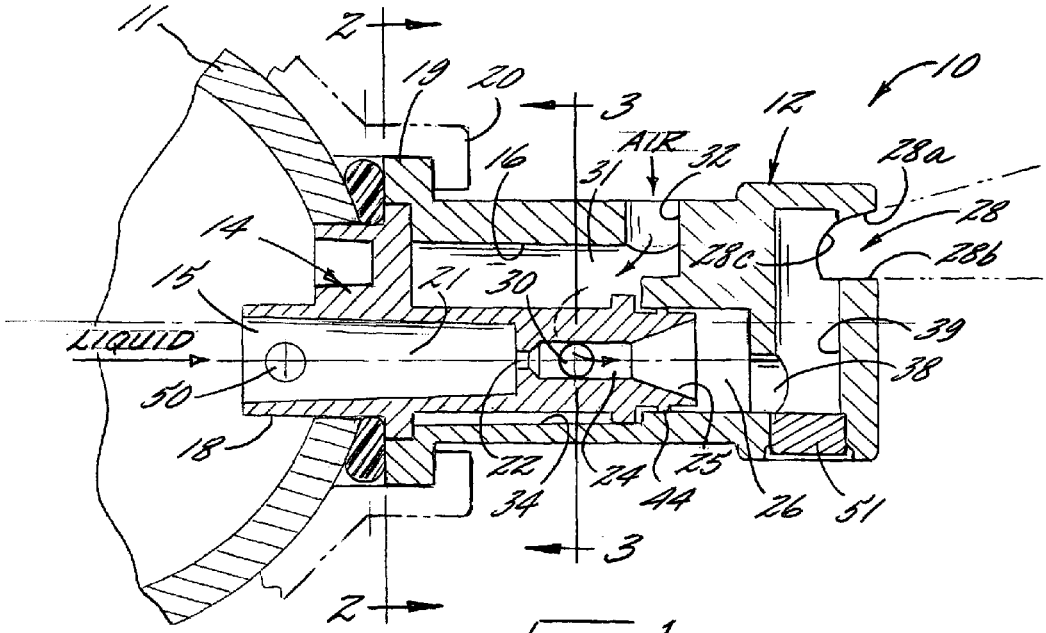
FIG. 1 is a horizontal section of an illustrative spray nozzle assembly in accordance with the invention mounted on a liquid supply boom.
Figure 2:
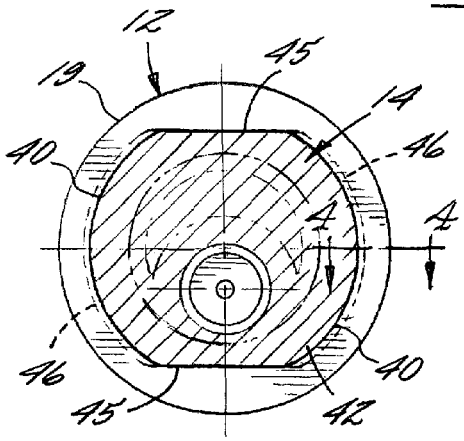
FIGS. 2 and 3 are vertical sections of the illustrated spray nozzle assembly taken to the planes of lines 2-2 and 3-3, respectively in FIG. 1.

While the invention is susceptible of various modifications and alternative constructions, a certain illustrated embodiment thereof has been shown in the drawings and will be described below in detail. It should be understood, however, that there is no intention to limit the invention to the specific form disclosed, but on the contrary, the intention is to cover all modifications, alternative constructions and equivalents falling within the spirit and scope of the invention.

DETAILED DESCRIPTION OF THE PREFERRED EMBODIMENT

Referring now more particularly to the drawings, there is shown an illustrative spray nozzle assembly 10 in accordance with the invention mounted on a liquid supply boom 11, such as the boom of an agricultural sprayer. The illustrated spray nozzle assembly 10 basically has a two part construction, comprising an outer nozzle body member 12 and an inner body insert 14. The body insert 14 in this case has a generally cylindrical construction, which defines a liquid flow passage 15 and is positionable within a cavity 16 in an upstream end of the outer body member 12. The body insert 14 has a cylindrical inlet end 18 protruding outwardly of the outer body member 12 and into the boom 11 through an aperture in one side of the boom 11. Pressurized liquid supplied to the boom 11 enters the spray nozzle assembly 10 through the liquid passageway 15. The outer body member 12 is formed with an annular retaining flange 19, which is secured to the boom 11 in a known manner, such as by means of a clamp 20. It will be appreciated that other means may be utilized for securing the nozzle on the boom, such as quick disconnect couplings of a known type The liquid flow passage 15 in this instance comprises a relatively large diameter upstream section 21 that communicates with a nozzling zone 23 in which the liquid flow stream is accelerated with a resulting pressure drop, which in turn communicates with an expansion chamber 26 in the outer body member 12. The nozzling zone 23 in this case includes a metering orifice 22 and an elongated downstream expansion chamber 24 having an outwardly flared conical downstream section 25. The nozzle body expansion chamber 26 in turn communicates with a discharge orifice 28 of the spray nozzle assembly 10.

In accordance with an important aspect of the invention, the spray nozzle assembly has a venturi air inlet that communicates between ambient air and the liquid flow passage at a location downstream of the metering orifice such that following a substantial pressure drop in the liquid upon passage through the metering orifice air is drawn into the liquid flow stream, which stabilizes the flow stream in downstream expansion chambers such that extremely fine liquid particles, such as those having a diameter less than 150 microns, are substantially eliminated from the flow stream prior to direction through the discharge orifice. To this end, in the illustrated embodiment, the nozzle body insert 14 has a venturi air flow passage 30 extending transversely through the expansion chamber 24 downstream of the metering orifice 22. The venturi air flow passage 30 in this case which communicates with an annular airflow passage 31 disposed in surrounding relation about the nozzle body insert 14, which in turn communicates with ambient air through an inlet passage 32 extending radially through a side of the outer nozzle body member 12. The annular passageway 31 in this instance is defined between the outer wall of the outer body member cavity 16 and the outer perimeter of the nozzle body insert 14.

Figure 3:
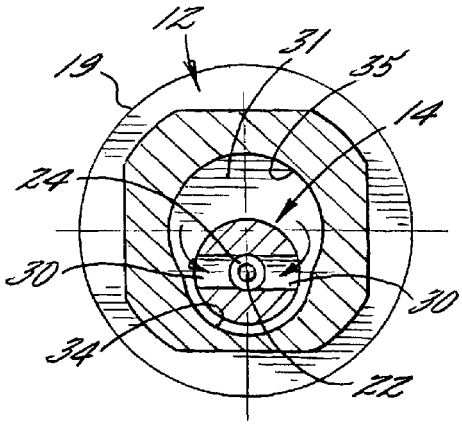

The illustrated cavity 16 has an irregular configuration defined by a cylindrical portion 34 concentric to the nozzle body insert 14 and a further radiused portion 35 in eccentric relation to the cylindrical portion 34 (see FIG. 3). It will be seen that as pressurized liquid is directed through the metering orifice 22, the resulting high velocity flow stream will generate a negative pressure at the venture air passageway 30, drawing ambient air through the annular passage 31 and inlet 32 for intermixing with the liquid flow stream.

In carrying out the invention, the outer body member has a liquid flow passage and discharge orifice configured to further agglomerate fine particles into the flow stream so as to enable the direction of a discharging liquid spray having particles adopted for a more efficient application onto agricultural foliage without undesirable drift. In this case, the expansion chamber 26 of the outer body member 12 into which the liquid/air stream is directed communicates through an eccentrically located longitudinal passage 38 between the expansion chamber 26 and one end of a transverse flow passage 30, which in turn communicates at its opposite end with the discharge orifice 28. In the preferred embodiment, the transverse passage 39 has a longitudinal length l between the longitudinal passage 38 and the discharge orifice 28 that is greater than the diameter d1 of the transverse passage 39. The diameter d1 preferably is larger than the diameter d2 of the expansion chamber 24, and the diameters d1 and d2 both are smaller in diameter than the diameter d3 of the nozzle body member expansion chamber 26. The longitudinal passage 38 preferably has a diameter of about one-half the diameter d3 of the expansion chamber 26 (see FIG. 5).

In further carrying out the invention, the discharge orifice of 28 of the spray nozzle assembly 10 is configured to further enhance spray performance and the direction of the relatively large substantially uniform sized droplets. To this end, the discharge orifice 28 is defined by a cross-cut or slot in the end of the outer nozzle body member which has substantially straight upper and lower sides 28*a*, 28*b* respectively, interconnected by a radiused section 28*c*. The cross-cut groove extends into the transverse passageway 39 a distance slightly less than the radius of the transverse passageway 39. The upper and lower flat surfaces 28*a*, 28*b* of the cross-cut define an angle of about 15° with the lower flat surface 28*b* being substantially perpendicular to the axis of the transverse passageway 39 and extending substantially into the transverse passageway 39 and the upper flat surface 28*a* being angled upwardly with respect to the lower flat surface 28*b* and extending only through the outer wall of the outer nozzle body member. The transverse passage 39 extends a small distance "x" beyond the upper flat surface 28*a* so as to effectively define a relatively small recess downstream of the discharge orifice 28 for further stabilizing the liquid particles in the flow stream prior to discharge from the spray nozzle assembly.

Figure 4:
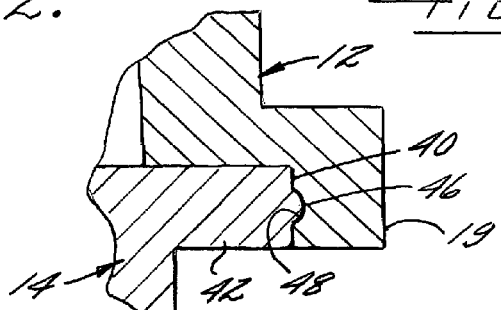
FIG. 4 is an enlarged fragmentary section taken in the plane of line 4-4 in FIG. 2.
Figure 5:
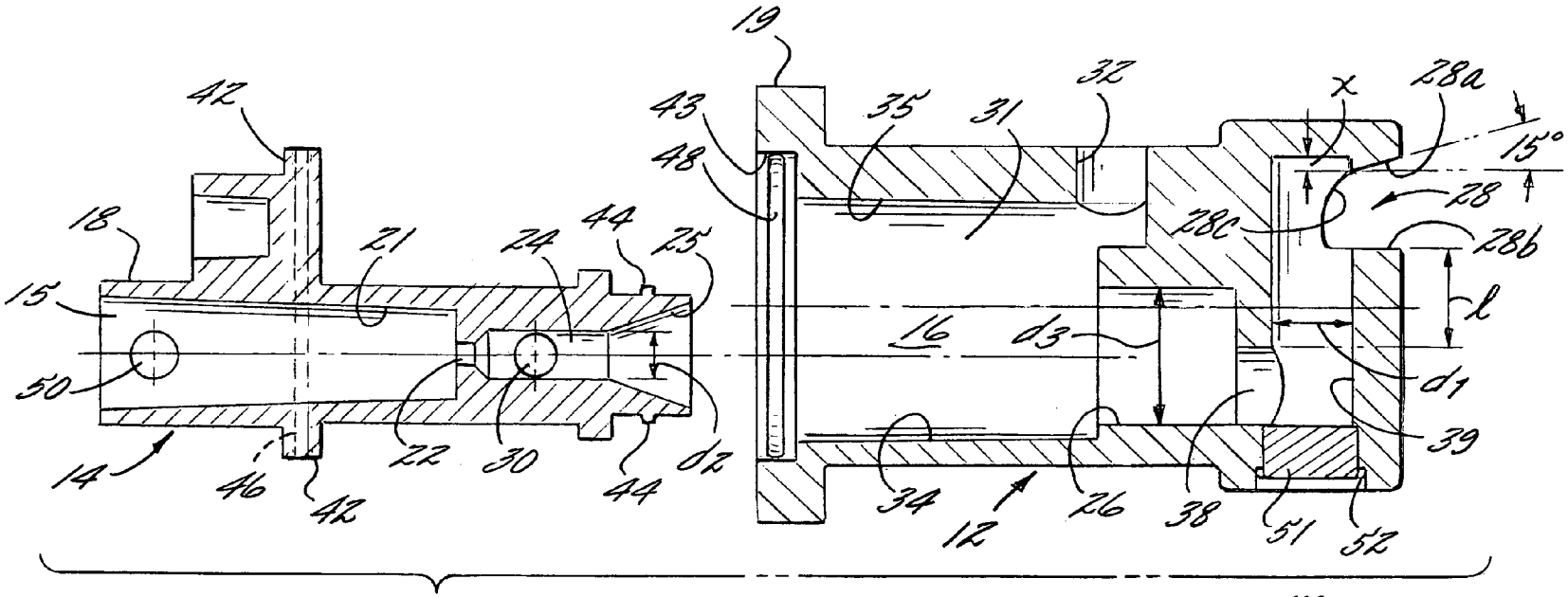
FIG. 5 is an exploded view of the illustrated spray nozzle assembly.

In further keeping with the invention, the nozzle body insert 14 and outer nozzle body member 12 are adapted for snap action assembly and disassembly to facilitate periodic cleaning of the nozzle parts. To this end, the nozzle body insert 14 has a radial locating flange 42 that is positionable into a corresponding mating recess 43 in an upstream end of the outer nozzle body member 12 upon mounting. The downstream end of the nozzle body insert 14 has radial sealing nibs 44 that are press fit into the wall of the outer body expansion chamber 26. To facilitate proper orientation of the nozzle body insert 14 into the outer nozzle body member 12, the locating flange 42 and corresponding nozzle body recess 43 are formed with parallel flats 45 on upper and lower sides thereof opposite arcuate sides 40. The locating flange arcuate sides 40 are formed with detent nibs 46 that are releasably engagable with detent recesses 48 in the outer nozzle body member 12 for enabling snap action engagement of the nozzle body insert 14 during assembly (see FIGS. 4-5). To facilitate removal of the nozzle body insert 14 for cleaning, the upstream protruding end 18 has a transverse aperture 50 that can receive a pin or other tool to facilitate pulling of the nozzle body insert 14 from the outer body member 12 with sufficient force to disengage the detents 46. It will further be appreciated by a person skilled in the art that the nozzle body insert 14 and the outer nozzle body member 12 have designs which facilitate efficient manufacture by plastic injection molding. In the illustrated embodiment, the upstream end of the transverse passage 39 of the outer nozzle body member 12 is closed by a separate plug 51 which is fixed, such as by ultrasonic welding 52, to the outer body member 12 following injection molding of the outer nozzle body member (FIG. 5).

Figure 6:
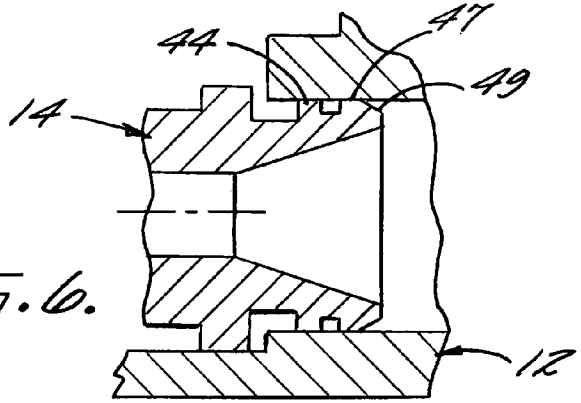
FIG. 6 is a fragmentary section depicting an alternative embodiment of a spray nozzle assembly.

With reference to FIG. 6, an alternative embodiment of nozzle body insert 14 is shown which includes a plurality of annular sealing ridges 44, 47 adapted for sealing engagement with the nozzle body counter bore 26. In this case, the nozzle body insert 14 is formed with a bevel or conical taper 49 at its downstream end to facilitate forceful entry and sealing engagement of the nozzle insert 14 into the outer body. Alternatively, a redundant annular sealing ring also could be provided in one or more of the annular grooves defined between the outer perimeter of the nozzle body insert 14 and the nozzle body bore 26.

From the foregoing, it can be seen that the spray nozzle assembly of the present invention has a design which is adapted for generating liquid particle spray discharges for more efficient application on agricultural foliage without undesirable drift. The nozzle assembly further is adapted for economical manufacture, and permits easy assembly and disassembly for periodic cleaning.

The invention claimed is:

1. A liquid spray nozzle comprising a nozzle body having a liquid inlet and a discharge orifice, said nozzle body having a liquid flow passage that includes an inlet section communicating with said liquid inlet for directing a pressurized liquid flow stream through said nozzle body to said discharge orifice, said liquid flow passage including a relatively small diameter nozzling zone having a longitudinal axis for accelerating the liquid flow stream directed through said nozzle body in a longitudinal direction and creating a pressure drop therein prior to discharge from said discharge orifice, said nozzle body having an ambient air passage having an inlet in communication with ambient air outside said nozzle, said ambient air passage including an venturi passage communicating with said nozzling zone transversely to the longitudinal axes of said nozzling zone such that a pressurized liquid flow stream passing through said nozzling zone draws ambient air in said ambient air inlet and venturi passage for mixing with the liquid flow stream prior to discharge from said discharge orifice, and said discharge orifice being eccentrically located relative to the longitudinal axis of said nozzling zone and the discharge of the accelerated liquid flow stream from said nozzling zone for altering the direction of the discharging liquid flow stream from said nozzling zone prior to discharge from said discharge orifice.

2. The spray nozzle of claim 1 in which said nozzle body includes an expansion chamber in downstream fluid communication with said nozzling zone in which the liquid flow stream passes and expands prior to discharge from said discharge orifice.

3. The spray nozzle of claim 1 in which said nozzling zone includes a metering section and a downstream relatively larger diameter expansion section.

4. The spray nozzle of claim 3 in which said liquid passage inlet section metering orifice and expansion section are in coaxial longitudinal alignment with each other, said nozzle body having an elongated transverse passage section with a longitudinal axis at an angle to the longitudinal axis of said inlet section, metering orifice, and expansion section.

5. The spray nozzle of claim 4 in which said ambient air inlet communicates with said venturi passage via an annular passage section in radiately space relation to said liquid flow passage.

6. The spray nozzle of claim 5 in which said liquid passage expansion section communicates with an upstream end of said transverse passage section through a passage way disposed eccentric to said liquid to said passage expansion section.

7. The spray nozzle of claim 6 in which said eccentric passage has a diameter less than the diameter of said transverse passage.

8. The spray nozzle of claim 4 in which said discharge orifice communicates through a side of said transverse passageway adjacent a downstream end thereof.

9. The spray nozzle of claim 8 in which said transverse passageway extends a distance beyond the discharge orifice in a downstream direction.

10. The spray nozzle of claim 8 in which said discharge orifice is defined at least in part by upper and lower flat surfaces disposed at an angle to each other.

11. The spray nozzle of claim 1 in which said nozzle body includes an outer body member and a body insert moveably mountable in said outer body member.

12. The spray nozzle of claim 11 in which said liquid passage inlet section, metering orifice, and expansion section are defined by said body insert, and said discharge orifice is defined by said outer body member.

13. The spray nozzle of claim 11 in which said body insert is adapted for snap action engagement with said outer body member.

14. The spray nozzle of claim 13 in which said body insert is formed with at least one locating flat for positioning the body insert within the outer body member with said venturi passage in predetermined position or said annular air passage.

15. A liquid spray nozzle comprising a nozzle body having a liquid flow passage that includes an inlet section for connection to a pressurized liquid supply and a discharge orifice, a relatively smaller diameter metering section, and an expansion section downstream of said metering section, said nozzle body having an ambient air passage having an inlet in communication with ambient air outside said nozzle, said ambient air passage including a venturi passage communicating said liquid passage expansion section such that a pressurized liquid flow stream directed into said expansion section from said metering orifice draws ambient air through said venturi passage into the liquid flow stream for mixing with the liquid flow stream prior to discharge from said discharge orifice, said liquid passage inlet passage inlet section, metering orifice, and expansion section being in coaxial longitudinal alignment with each other, and said discharge orifice being eccentrically located relative to said coaxially aligned liquid passage inlet section, metering orifice, and expansion chamber for altering the direction of the liquid flow stream directed into said expansion section prior to discharge from said discharge orifice.

16. The spray nozzle of claim 15 in which said nozzle body having an elongated transverse passage section communicating between said expansion section and discharge orifice with a longitudinal axis at an angle to the longitudinal axis of said inlet section, metering orifice, and expansion section.

17. The spray nozzle of claim 16 in which said nozzle body includes an outer body member and a body insert moveably mountable in said outer body member, said liquid passage inlet section, metering orifice, and expansion section being defined by said body insert, and said transverse passage and discharge orifice being defined by said outer body member.

18. The spray nozzle of claim 17 in which said ambient air inlet is formed in said outer body member, said venturi passage is formed in said body insert, and said body insert and outer body member define an annular air passage communicating between said ambient air inlet and said venturi passage.

19. The spray nozzle of claim 15 in which said nozzle body is formed with a cylindrical bore for receiving a downstream end of said nozzle insert in liquid tight sealing engagement.

20. The spray nozzle of claim 19 in which said downstream end of said nozzle insert is formed with at least one angular sealing rib for press fit sealing engagement with said nozzle body cylindrical bore.

21. A liquid spray nozzle comprising a nozzle body having a liquid inlet and a discharge orifice, said nozzle body having a liquid flow passage that includes an inlet section communicating with said liquid inlet for directing a pressurized liquid flow stream through said nozzle body to said discharge orifice, said liquid flow passage including a relatively small diameter nozzling zone for accelerating the liquid flow stream directed through said nozzle body and creating a pressure drop therein prior to discharge from said discharge orifice, said nozzle body having an ambient air passage having an inlet in communication with ambient air outside said nozzle, said ambient air passage including an venture passage communicating with said nozzling zone such that a pressurized liquid flow steam passing through said nozzling zone draws ambient air in said ambient air inlet and venture passage for mixing with the liquid flow stream prior to discharge from said discharge orifice, said nozzle body including an outer body member and a body insert removeably mountable in said outer body member, said liquid passage inlet section, metering orifice, and expansion section being defined by said body insert, said discharge orifice and ambient air inlet being defined by said outer body member, and said venture passage being formed in said body insert, and said body insert and outer body member defining an annular air passage communicating between said ambient air inlet and said venture passage.

* * * * *